United States Patent [19]

Tada et al.

[11] 4,320,548

[45] Mar. 23, 1982

[54] METHOD OF ERECTING A BRIDGE GIRDER

[75] Inventors: Hiroshi Tada, Yokohama; Wataru Abe, Hiratsuka; Toshiro Nozu, Zama; Keizo Ishikawa, Yamato, all of Japan

[73] Assignee: Oiles Co., Ltd., Tokyo, Japan

[21] Appl. No.: 55,320

[22] Filed: Jul. 6, 1979

[30] Foreign Application Priority Data

Jul. 7, 1978 [JP] Japan ..... 53-081972

[51] Int. Cl.[3] ..... E01D 21/00

[52] U.S. Cl. ..... 14/1; 14/16.1; 248/679

[58] Field of Search ..... 14/16.1, 1, 77; 404/1; 248/679, 678

[56] References Cited

U.S. PATENT DOCUMENTS

| | | | |
|---|---|---|---|
| 2,680,259 | 6/1954 | Milk | 14/16.1 |
| 3,105,252 | 10/1963 | Milk | 14/16.1 |
| 3,390,854 | 7/1968 | Sherburne | 14/16.1 X |
| 3,397,856 | 8/1968 | Sullivan | 14/16.1 X |
| 3,484,882 | 12/1969 | Blanchette | 14/16.1 |
| 3,921,240 | 11/1975 | Fyfe | 14/16.1 |
| 3,979,787 | 9/1976 | Ahlgren | 14/16.1 |
| 4,087,220 | 5/1978 | Koss | 14/1 X |

FOREIGN PATENT DOCUMENTS

| | | | |
|---|---|---|---|
| 795501 | 10/1968 | Canada | 14/16.1 |
| 2039631 | 2/1972 | Fed. Rep. of Germany | 14/16.1 |

*Primary Examiner*—Nile C. Byers, Jr.

*Attorney, Agent, or Firm*—George B. Oujevolk

[57] ABSTRACT

This invention relates to a method of bridge erection i.e., an arrangement for erecting a bridge girder. More particularly, it is concerned with an erection method, in which a bridge girder is smoothly extruded, together with a movable member, on a temporary support member which is disposed on an upper shoe until the girder reaches a position near the installation position, whereupon a coupling member for connecting the upper shoe with a sole plate which is pre-fixed to the girder, is attached to the sole plate, then in this condition the girder is again moved forward up to the installation position while pushing the end portion of the temporary support member on the upper shoe by the coupling member so as to displace the temporary support member and the movable member by the coupling member, whereby the bridge girder and the support structure are fixed in engagement with each other without the need to lift the bridge girder.

4 Claims, 10 Drawing Figures

METHOD OF ERECTING A BRIDGE GIRDER

FIELD OF THE INVENTION

This invention relates to a method of erecting a bridge girder and more particularly to the erection of a bridge girder by a straightforward substantially horizontal movement without the necessity of lifting the girder vertically to place it into position.

DESCRIPTION OF THE PRIOR ART

In the extrusive bridge erection methods heretofore adopted, as is illustrated in FIG. 1, when pushing out (or pulling out) a bridge girder (superstructure) G and installing it on a bridge pier (substructure) B, the bridge girder G is first manufactured in the form of a unit ranging from several meters to several tens of meters in length on a manufacturing block which is provided behind the abutment and, after hardening of concrete, a launching girder A is attached to the bridge girder G, then the bridge girder G is installed on a temporary support structure C mounted on the bridge pier B, the temporary support structure C being composed of a suitable bearing block, e.g. a steel or concrete block, and a slide member disposed thereon, then the bridge girder G is pushed (or pulled) by an extruding device D which is attached to the bridge girder G directly or to the bridge pier B, and is thereby made to slide out on the bearing block; or alternatively, a bearing block is slidably placed on a plate fixed for example to the bridge pier B to form a movable block, then placing the bridge girder G on the movable bearing block and pushing (or pulling) the bearing block on the said plate by the extruding device D to allow it to slide on the plate whereby the bridge girder G is pushed forward (or pulled out).

However, these methods involve various problems. In any of the above methods it is necessary that, after the bridge girder G has reached its installation position and the so-called pushing-out (or pulling-out) completed, the temporary support structure C should be removed and then a regular support structure should be installed to support the bridge girder G. The operation for removing the temporary support structure C is performed by lifting the bridge girder G with a vertical jack E or the like. However, since the amount of lifting for the bridge girder G cannot be large in point of execution of works, the gap between the bridge girder G and the bridge pier B is not sufficiently large, so that the operation is performed manually in many cases; in addition, such operation is troublesome and not desirable from the economic point of view.

To solve such problems there had been made various studies; as a result, in Japanese Patent Application No. 15890/78 there was proposed such a bridge erection method as shown in FIG. 2; that is, a regular support structure S having a movable part between the upper and lower shoes, which is usually employed as a bridge bearing, is used from the beginning, for example, a rolling support structure in which the moving part is a roller or rocker, a hinged support structure using pins, a sliding support structure using a sliding plate or bearing plate with a curved portion, a rubber support structure using rubber, or the combination thereof, and, without using the temporary support structure C, the regular support structure S is allowed to act as a temporary support structure at the time of installation of the bridge girder and, after completion of the girder installation, it is fixed in place so as to provide the desired bearing function. More particularly, on the support structure S is disposed a movable member T made of a thin steel plate or the like capable of moving in the direction of the bridge axis, namely in the extruding direction, then the bridge girder G is placed on the movable member T and is pushed forward together with the movable member T as far as the installing position on the support structure S by means of an extruding device D which is attached to the bridge pier B or directly to the bridge girder G, then, in this condition, the bridge girder G is lifted using the vertical jack E or the like, then the movable member T on the support structure S is removed and the vertical jack E is let down to allow the support structure S and the bridge girder G to be fixed in engagement with each other.

Even in such bridge erection, however, there still remain the following inconveniences regarding the fixing method for the support structure S and the bridge girder G.

In such bridge erection, when fixing the sole plate which is pre-fixed to the bridge girder G side, on the upper shoe which is disposed on the bridge pier B side, after the bridge girder G has reached the installing position, the removal of the movable member T, which is disposed on the upper shoe and is in sliding contact therewith to move the bridge girder G, is performed by lifting the bridge girder G using the vertical jack E or the like. In this case, however, the lifting operation for the bridge girder G must be done almost simultaneously on each bridge pier B in order to prevent the occurrence of an eccentric load on the bridge girder G and besides, the removing operation for the movable member T must be done manually.

SUMMARY OF THE INVENTION

It is the object of the present invention to provide a bridge erection method whereby a bridge girder and a support structure can be fixed together easily, in which a bridge girder G is smoothly extruded, together with a movable member, on a temporary support member which is disposed on the upper shoe until the girder G reaches a position near its installation position, whereupon a coupling member for connecting the upper shoe with a sole plate which is pre-fixed to the girder G, is attached to the sole plate, then in this condition the girder G is again pushed forward as far as the installation position while pushing the end portion of the temporary support member on the upper shoe by the coupling member so as to displace the temporary support member and the movable member by the coupling member, so that the bridge girder G and the support structure are fixed in engagement with each other without the need to lift the girder G.

The gist of this invention resides in an extructive bridge erection method, which method comprises, fixing on a bridge pier a support structure including a lower shoe, an upper shoe, a movable part disposed between the lower shoe and the upper shoe, a temporary support member having a sliding member temporarily fixed on the upper shoe, a movable member disposed so as to move in the normal direction of the bridge axis on the sliding member in the temporary support member, placing a bridge girder having a sole plate affixed thereto in a predetermined position coincident with the position of the support structure on the movable member, pushing out continuously the bridge girder to a position near its installation position in the forward direction of the bridge axis together with the movable member on the temporary support member by means of an extending device, removing the temporary fixing means of said temporary support member with the upper shoe to be able to move the temporary support member in regard to the upper shoe in the direction of the bridge axis, while attaching to the sole plate a coupling member thrusting out from the lower surface of the bridge girder in the position near its installing position, thereafter again pushing out the bridge girder by the extruding device, pushing out the temporary support member on the upper shoe by the coupling member so as to displace the temporary support member and the movable member by the coupling member on the upper shoe, then in this position, fixing the upper and the sole plate in engagement with each other through the coupling member.

The invention as well as other objects and advantages thereof will become more apparent from the following detailed description when taken together with the accompanying drawings, in which:

DETAILED DESCRIPTION OF THE INVENTION

Figure 1:
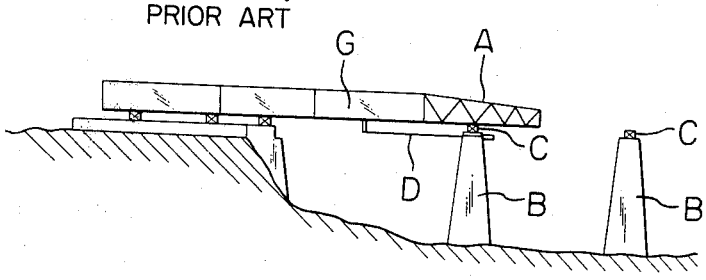
FIG. 1 PRIOR ART
FIG. 1 is a schematic view of a conventional extrusive bridge erection.
Figure 2:
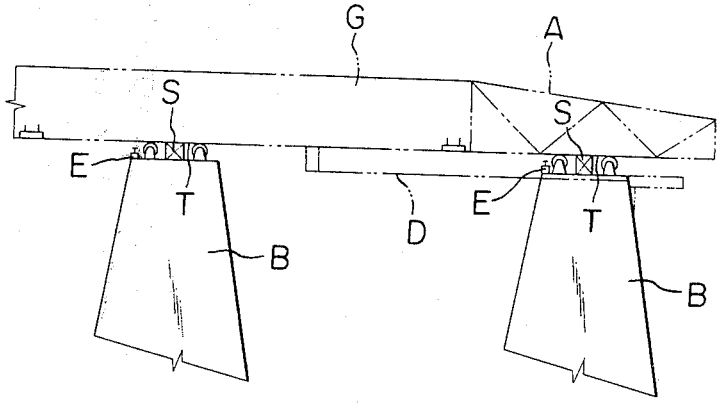
FIG. 2 PRIOR ART
FIG. 2 illustrates a conventional extrusive bridge erection using a conventional support structure.

Embodiments of this invention capable of achieving the foregoing object of the invention and satisfying the essential construction thereof are described below in detail with reference to the accompanying drawings.

The reference numeral 1 is a support structure disposed between the bridge pier B and the bridge girder G, the support structure being composed of a lower shoe 2 fixed to the bridge pier B, a movable part 3 disposed on the lower shoe 2 and functioning to remove inclination or other displacement as well as shrinkage of the bridge girder G, an upper shoe 4 disposed on the movable part 3, a sole plate 5 fixed to the bridge girder G, a coupling member 6 which connects the sole plate 5 with the upper shoe 4, holding means 7, 7' disposed at both ends of the upper and lower shoes 4, 2 in the direction of the bridge axis, and a movable member 8 made of a thin steel plate disposed so as to be movable on the upper shoe 4 in the direction of the bridge axis.

The term "movable part" as used throughout this invention is intended to mean the roller or rocker section in roller bearings, the pin section in hinge bearings, the sliding plate section or bearing plate section having a convex curved surface in sliding bearings, the rubber section in rubber bearings, and any suitable combination of these elements which will accomplish the purpose of allowing changes in girder position such as its inclination and tolerating girder expansion and contraction.

The present invention will be described hereinafter in connection with a support structure including a movable section having a bearing plate disposed between the upper and lower shoes and having a convex curved surface.

The lower shoe 2, which is fixed to the bridge pier B with anchor bolts 9 or the like, has an inwardly concaved surface 13 which is in sliding contact with a convex curved surface 10 of a bearing plate 12 which constitutes the movable part 3, the bearing plate 12 having the convex curved surface 10 as one surface and a plane surface as the other surface, and the lower shoe 2 is further provided with projecting portions 14 which project from the upper surface of the lower shoe 2 at both ends thereof in the direction normal to the bridge axis so as to put the inwardly concaved surface 13 therebetween.

The upper shoe 4 is provided centrally on its upper surface 15 with a slot 17 extending along the direction normal to the bridge axis and constituting an engaging portion 16, and the coupling member 6 is also provided with retaining holes 18 for engagement with the sole plate 5 formed at both ends thereof in the direction of the bridge axis.

The upper shoe 4 is further provided with stepped portions 19 at both ends thereof in the direction normal to the bridge axis. At both ends in the direction of the bridge axis of the stepped portions 19 are formed notches 21 leaving ear portions 20, the notches 21 being adapted to engage the projections 14 of the lower shoe. The lower surface of the upper shoe 4, which is formed smooth, is in sliding contact with the plane surface 11 of the bearing plate 12 and fitting over the inwardly concaved surface 13 of the lower shoe. On the other hand, the upper surface of the upper shoe 4 serves as a connecting surface with the coupling member 6.

The reference numeral 23 represents hook-like side blocks fixed with bolts or the like to the projections 14 of the lower shoe and functioning to retain the stepped portions 19 of the upper shoe in the vertical direction.

The sole plate 5 is provided centrally on its lower surface 24 with a downward concave 26 which constitutes an engaging portion 25, and the coupling member 6 is also provided at both ends thereof in the direction of the bridge axis with bolt holes 27 which coincide with the retaining holes 18 of the upper shoe, and is further provided in its lower surface 24 with bolt holes 28 for fixing the coupling member 6.

The sole plate 5 is embedded in the bridge girder G with anchor bolts 29 or the like beforehand when manufacturing the girder G so that its lower surface 24 is flush with the girder G in a position where the girder G after installation coincides with the position of the support structure 1 mounted on the bridge pier B.

The coupling member 6 is provided centrally on its upper surface 30 with a convex portion 31 for engagement with the engaging portion 25 of the sole plate, and is further provided about the convex portion 31 with engaging holes 33 which coincide with the bolt holes 28. The coupling member 6 is also provided at both ends thereof in the direction of the bridge axis with through holes 32 which coincide with the bolt holes 27 of the sole plate and also coincide with the retaining holes 18 which is provided with the upper shoe 4.

Further formed centrally on the lower surface 34 of the coupling member 6 is a slot 35 coincident with the slot 17 of the upper shoe 4. And at both ends in the direction of the bridge axis of the coupling member 6 there are formed projecting portions 36 which extend along the direction of the bridge axis and which are spaced by a distance equal to the length of the upper shoe 4 in the direction of the bridge axis so as to engage the upper shoe 4.

The reference numeral 37 represents tapered portions formed, in the extruding direction, on the side end portion of the coupling member 6. The tapered portions 37 act as a guide for engagement of the coupling member 6 with the upper shoe 4.

Regarding the holder devices 7 and 7', one holder device 7 is disposed in the rear in the extruding direction relative to the support structure 1, in other words, on the starting-point side of extrusion, while the other holder device 7' is disposed in front in the extruding direction relative to the support structure 1, both holder devices 7 and 7' being fixed at the respective base portions to the bridge pier B with bolts or the like.

The holder device 7 disposed behind the support structure 1 functions to send out the movable member 8, which is supported in rolled state or the like, at the time of girder installation, while the holder device 7' disposed in front functions to wind the movable member 8 after passing over the upper shoe 4.

The numerals 38 and 38' are pressure levers of the holder devices 7 and 7', respectively. The levers 38 and 38' are provided at the tip ends thereof with rollers 39 and 39', respectively. Even if the bridge girder G undergoes a very small vertical displacement at the time of its installation, the movable member 8 is kept urged to the girder G through the rollers 39, 39'.

It is desirable for the movable member 8 comprising of a thin steel plate to be supported in rolled state by the holder devices 7, 7' and supplied for, however, it is possible to use the thin steel plate cut into predetermined sheets having predetermined length without being supported by the holder devices 7, 7' for the movable member 8.

In the drawings, the movable member 8 supported by the holder devices so as to roll is shown as a second embodiment.

The numeral 40 represents retaining members disposed between the notches 21 of the upper shoe 4 and the projections 14 of the lower shoe 2, whereby, the relative movement in the direction of the bridge axis between the lower shoe 2 and the upper shoe 4 is prevented at the time of installation of the bridge girder G, and after the installation of the bridge girder G, the retaining member 40 is removed, and thereby a gap in the direction of the bridge axis between the notches 21 of the upper shoe 4 and the projections 14 of the lower shoe 2 is left so that the support structure 1 functions as a movable bearing for the gap allows the movement and inclination of the bridge girder G within the settled limits and in the direction of the bridge axis. In the case that the retaining members 40 are not removed after the installation of the bridge girder G and used in its settled condition the movement of the bridge girder G in the direction of the bridge axis is prevented but the inclination of the bridge girder G is so arranged that the support structure works as a fixed bearing.

Especially, in the case that the support structure works as the fixed bearing for its function, it is possible for the support structure to have the fixed bearing function by previously reducing the gap between the notches 21 of the upper shoe 4 and the projections 14 of the lower shoe 2.

Generally, the bridge girder is supported by the movable bearing allowing the movement and inclination of the direction of the bridge axis and by the fixed bearing preventing the movement of the bridge girder in the direction of the bridge axis but allowing the inclination of the bridge girder.

In the support structure 1 stated hereinabove, it is possible for the retaining member 40 either to be removed after the installation of the bridge girder G so as to work having the movable bearing function or not to be removed so as to work having the fixed bearing function.

In the drawings and in the erection method described hereinafter, i.e., according to one mode of the present invention, the retaining members 40 are disposed between the notches 21 of the upper shoe 4 and the projections 14 of the lower shoe 2 at the time of installing the bridge girder G so as to prevent the relative movement between the upper shoe and the lower shoe in the direction of the bridge axis, and the retaining members 40 are removed after the installation of the bridge girder G so that the support structure 1 works having the movable bearing function.

The numeral 41 is a temporary support member disposed on the upper surface 15 of the upper shoe. The temporary support member 41 has an inverted U-shape in section having leg portions 42. In the surface opposite to the leg portions 42 is formed a concave 43 in which fits a sliding member 44. To prevent the temporary support member 41 from moving on the upper shoe 4 when the movable member 8 slides on the sliding member 44, the leg portions 42 of the temporary support member 41 are engaged with the sides of the upper shoe 4 in the direction normal to the bridge axis and are fixed to the upper shoe 4 with bolts or the like.

Figure 6:
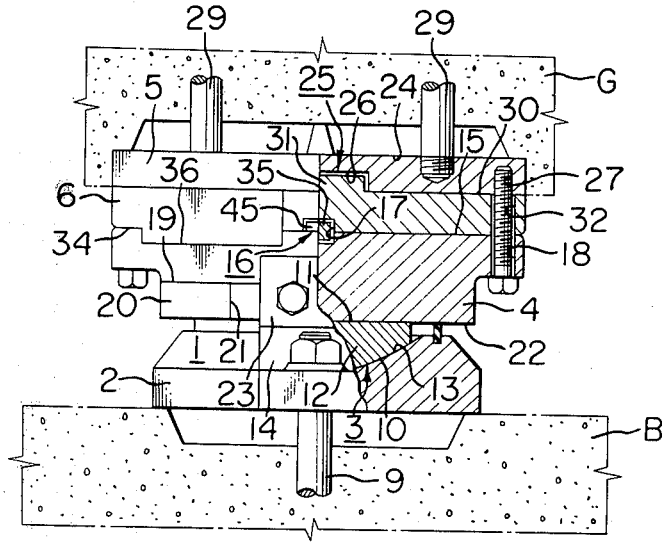
FIG. 6 is a side view partly in longitudinal section of the support structure after erection.
Figure 7:
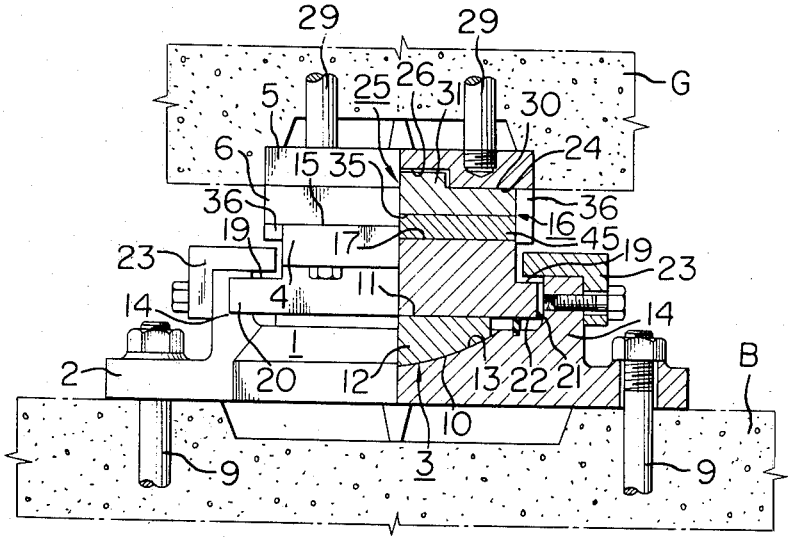
FIG. 7 is a front view partly in longitudinal section thereof.

In FIGS. 6 and 7, the numeral 45 is a retaining piece for engagement of the upper shoe 4 with the coupling member 6. The retaining piece 45 fits in the slot 17 which constitutes the engaging portion 16 of the upper shoe, and also fits in the slot 35 of the coupling member.

The extensive erection of the bridge girder G and the method of fixing the support structure 1 are described below in detail.

The support structure 1, with the temporary support member 41 are disposed on the upper shoe 4 by fixing its leg portions 42 with bolts or the like, and the holder devices 7, 7' with the movable member 8 disposed on the temporary support member 41 of the support structure, are placed and fixed onto the bridge pier B. On the movable member 8 over the support structure 1 is then placed the bridge girder G to which is attached a launching girder A manufactured on the manufacturing block behind the abutment.

Figure 3A:
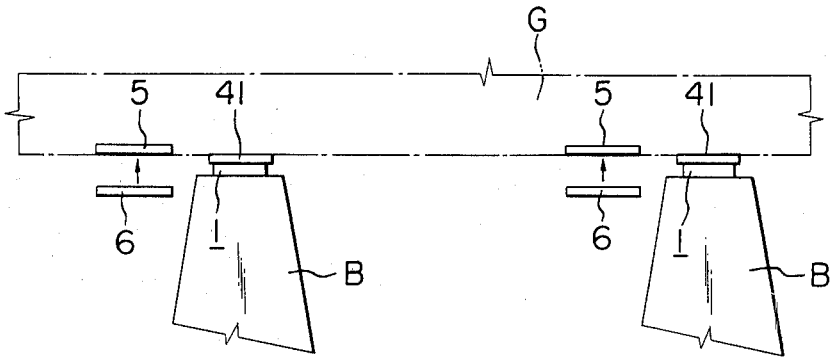
FIGS. 3(*a*) through 3(*c*) illustrates the extrusive bridge erection method of this invention.
Figure 3B:
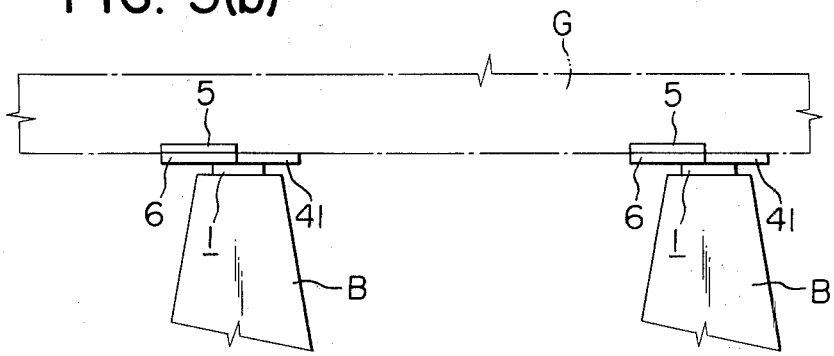
Figure 3C:
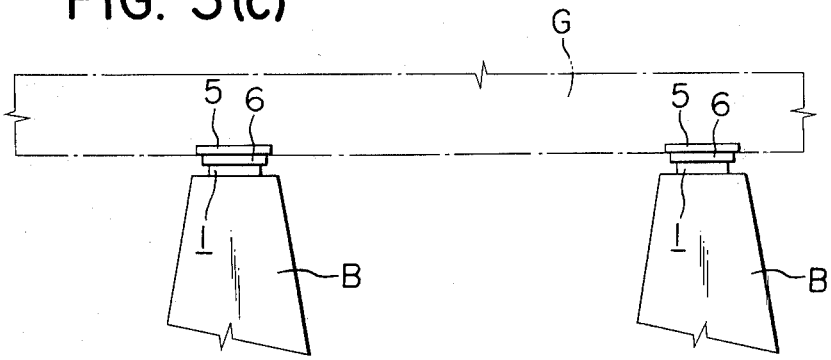
Figure 4:
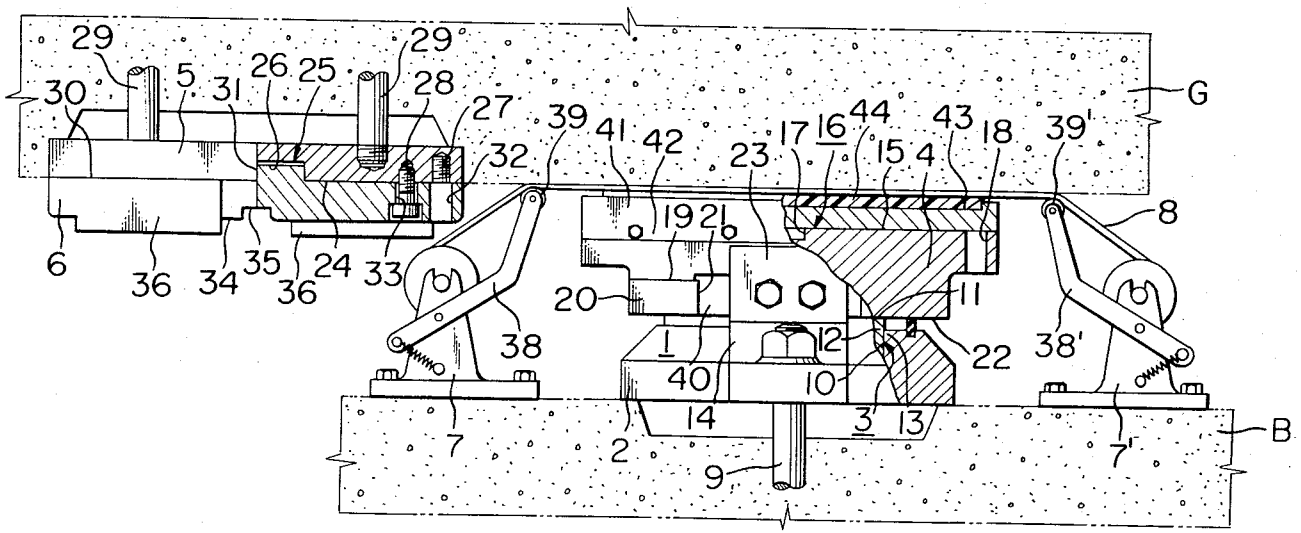
FIG. 4 is a side view partly in longitudinal section of a support structure according to this invention in the extrusion of a bridge girder.
Figure 5:
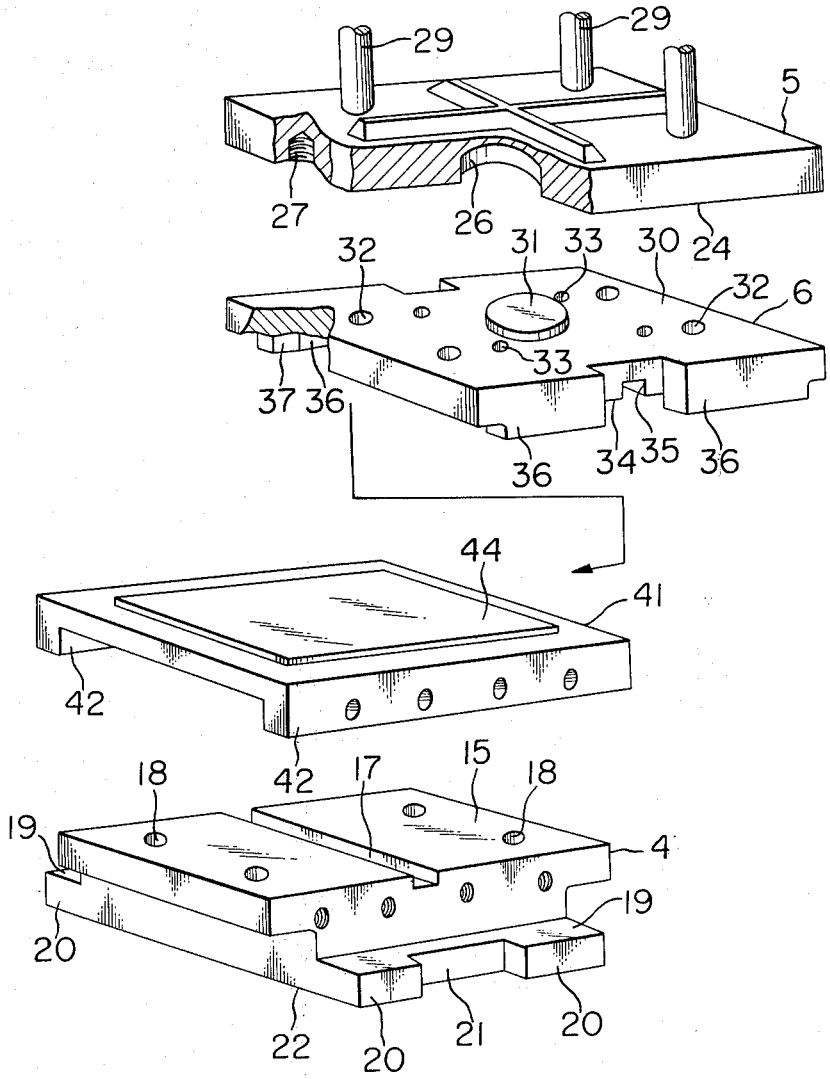
FIG. 5 is a perspective view showing the shape and arrangement of the upper shoe, temporary support member, coupling member and sole plate.

Thereafter, using the extruding device D attached to either the bridge pier B or the bridge girder G, the bridge girder G is extruded forward on the temporary support member 41 together with the movable member 8 which is in sliding contact with the sliding member 44 of the temporary support member 41, and concrete is poured into the empty manufacturing block mold so as to form the bridge girder G which has been extruded forward. The bridge girder G is then continuously extruded forward to a predetermined vicinity of the support structure 1. In this bridge erection method, the bridge girder G is made of concrete or block concrete, and the movable plate 8 on which the bridge girder G is placed is disposed on the sliding member 44 engaged with the temporary support member 41, therefore, at the time of pushing out the bridge girder G, frictional resistance is so small between the sliding member 44 and the movable member 8 that the bridge girder 8 is smoothly pushed out with the movable member 8 on the support structure 1. And in this position the tapered portions of the projecting portions 36 are opposed to the upper shoe 4 so that the projecting portions 36 of the coupling member 6 engage the sides of the upper shoe 4 in the direction normal to the bridge axis, then convex portion 31 formed on the upper surface of the coupling member 6 is fitted in the downward concave 26 of the sole plate and the bolts inserted in the engaging holes 33 are threaded into the bolt holes 28 of the sole plate to fix the latter and the coupling member 6 integrally with each other [see FIG. 3(*a*) as well as FIGS. 4 and 5]. Thereafter, the bolts which have been used to fix the temporary support member 41 to the upper shoe 4 are removed and allowed to move in the direction of the bridge axis and the movable member 8 sent out from the holder device 7 is detached at the end of the upper shoe 4. The bridge girder G is again extruded forward by the moved device D to allow the temporary support member 41 to be displaced by the coupling member 6. In this case, the temporary support member 41 is pushed by the coupling member 6 with the projecting portions 36 of the latter made as guide to the upper shoe 4 so that the slot 35 formed on the lower surface 34 of the coupling member coincides with the slot 17 which constitutes the engaging portion 16 of the upper shoe, and thus the temporary support member 41 as well as the movable member 8 thereon are pushed forward whereby they are displaced by the coupling member 6. In this condition, namely in the condition of completed displacement of the temporary support member 41 by the coupling member 6 [see FIG. 3(*c*)], the retaining piece 45 for engagement of the upper shoe 4 with the coupling member 6 is fitted in the slot 17 of the upper shoe and also in the slot 35 of the coupling member 6, and the bolts inserted in the retaining holes 18 of the upper shoe and also in the through holes 32 of the coupling member are threaded into the bolt holes 27 of the sole plate, whereby the upper shoe 4 and the sole plate 5 are fixed together through the coupling member 6.

Then the retaining members 40 disposed between the upper shoe 4 and lower shoe 2, which have been used to prevent the relative movement in the direction of the bridge axis between the upper shoe 4 and the lower shoe 2 at the time of installation of the bridge girder G, are removed. And in this support structure 1, a gap is formed between the notches 21 of the upper shoe 4 and the projections 14 of the lower shoe 2 so that after the installation of the bridge girder G, said gap works as its function for the support structure 1 to allow the movement and inclination of the bridge girder G within a certain limit in the direction of the bridge axis.

The extruding device D and the holder devices 7, 7' are also removed. Now the girder installation is completed (see FIGS. 6 and 7). Before completion of the girder installation, the upper surface 15 of the upper shoe of the support structure 1 is brought into sliding contact with the coupling member 6 and the temporary support member 41; that is, the temporary support member 41 as it is pushed by the coupling member 6 is displaced by the latter while in sliding contact with the upper surface 15 of the upper shoe. Thereafter, a coating layer of a sliding member having a self-lubricating property is formed on either the upper surface 15 of the upper shoe or the lower surface of the temporary bearing member 41 and teh lower surface 34 of the coupling member 6 so that the above-mentioned displacement may be performed smoothly.

The leg portion 42 of the temporary support member and the projecting portions 36 of the coupling member are formed so as not to abut the lower shoe 2 when they are positioned on the upper shoe 4 so that the displacement operation for the temporary bearing member 41 and the coupling member 6 may be carried out smoothly.

Under such construction, the bridge girder G is moved forward so far as a position near its installing position and in this condition the coupling member 6 for connecting the upper shoe 4 with the sole plate 5 is attached to the sole plate 5, then the bridge girder G is further extruded so far as the installing position while pushing the temporary support member 41 on the upper shoe 4 by the coupling member 6, whereby the temporary support member 41 can be easily displaced by the coupling member 6 and at the same time the sole plate 5 prefixed to the bridge girder G can be fixed to the upper shoe 4—which has carried thereon the temporary support member 41— of the support structure 1 disposed beforehand on the bridge pier B and adapted to support the extrusion of the bridge girder G.

By adopting the above erection method, the transfer of the load of the bridge girder G from the temporary support member 41 to the coupling member 6, that is, the transfer of the weight of the bridge girder G to the coupling member 6 from the temporary support member 41 which has borne the weight of the girder G, can be attained smoothly because of the displacement of the movable part 3, that is, because the sliding movement of the temporary support member 41 and the coupling member 6 on the upper shoe 4 leads to inclination of the upper shoe 4 on the starting-point side of extrusion due to the sliding contact between the inwardly concaved surface 13 of the lower shoe 2 and the convex curved surface 10 of the bearing plate 12.

In the support structure 1 of the present invention, moreover, displacements such as inclination and shrinkage of the bridge girder G occurring after installation of the latter are removed by the sliding contact between the movable part 3, namely the convex curved surface of the bearing plate 12 and the inwardly concaved surface 13 of the lower shoe, and also by the sliding contact between the plane surface 11 of the bearing plate 12 and the lower surface 22 of the upper shoe.

After the girder installation, moreover, the movement in the direction of the bridge axis and in the direction normal to the bridge axis of the upper shoe 4 and the coupling member 6 which connects the upper shoe with the sole plate 5 is prevented by the abutment in such directions of the notches of the upper shoe 4 with the projections 14 of the lower shoe, by the engagement of the retaining piece 47 with the slots 17 and 35 of the upper shoe 4 and the coupling member 6, respectively, by the engagement and abutment of the projecting portions 36 of the coupling member 6 with the sides of the upper shoe, and further by the engagement of the downward concave 26 of the sole plate with the convex portion 31 of the coupling member.

The lifting of the bridge girder G after its installation is prevented by the side blocks 23, the side blocks 23 being fixed to the projecting portions 14 of the lower shoe so as to vertically retain the stepped portions 19 of the upper shoe, which prevent the rising of the upper shoe from the lower shoe, and also by the bolts threaded into the upper shoe 4 and the sole plate 5 through the coupling member, which prevent the rising of the sole plate from the upper shoe.

In the foregoing embodiment, there were formed the slots 17 and 35 centrally in the upper surface 15 of the upper shoe and centrally in the lower surface 34 of the coupling member, respectively, in order to dispose the retaining piece 45 for engagement of the upper shoe 4 with the coupling member 6. But the position of the slots 17, 35 is not restricted to the center of the upper and lower surface 15, 34. In addition, such slots may be formed each in plural numbers.

Figure 8:
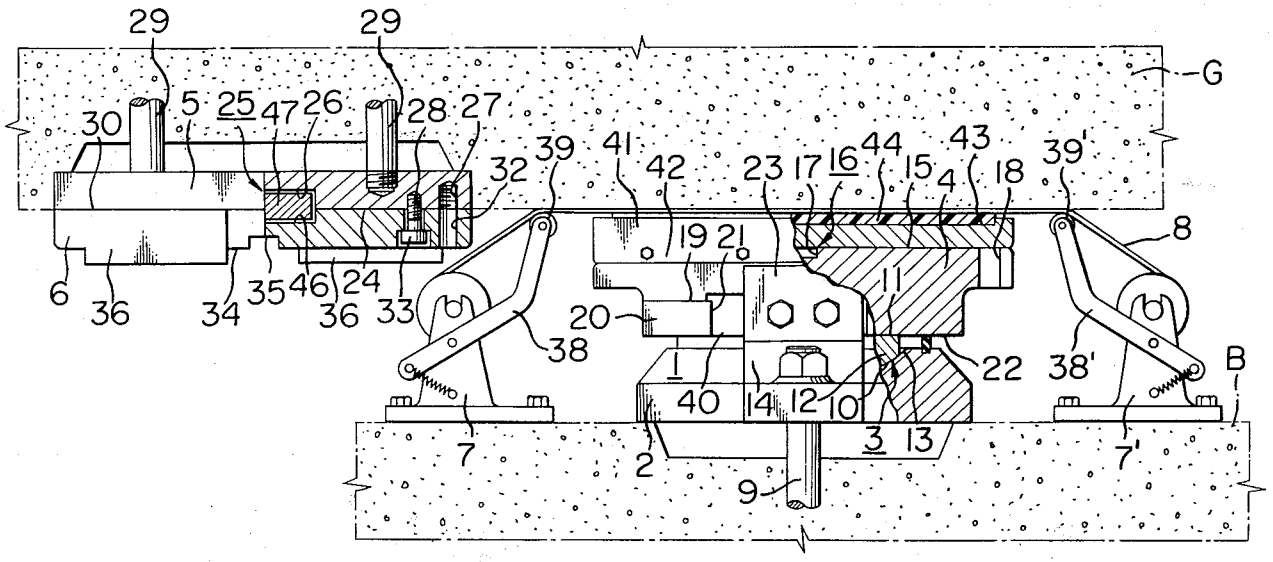
FIG. 8 is a side view partly in longitudinal section of a support structure according to another embodiment of this invention in the extrusion of the bridge girder.

FIG. 8 shows another embodiment in which an upward concave portion is formed in the upper surface of the coupling member 6 so as to coincide with the downward concave portion 26 of the sole plate, and a separately manufactured retaining member 47 is inserted in the upward and downward concave portions 46, 26 to prevent the movement in the direction of the bridge axis and in the direction normal to the bridge axis of the coupling member 6 and the sole plate 5.

It is to be observed therefore that according to the present inventive concept, a bridge girder which is to be installed is fixed to the support structure, and more concretely the sole plate secured to the bridge girder side is fixed to the upper shoe secured to the bridge pier side, in such a manner that a temporary bearing member is disposed on the upper shoe, then the bridge girder is pushed forward on the temporary bearing member to a position near its installing position, thereafter a coupling member is attached to the sole plate which is fixed to the bridge girder G, then the temporary bearing member is pushed forward by the coupling member to displace it by the coupling member, so that the removal of the temporary bearing member and the fixing of the upper shoe and the sole plate can be readily accomplished without lifting the bridge girder.

What is claimed is:

1. A method for erecting a bridge girder comprising:

(a) affixing upon at least a first bridge pier, a support structure including a lower shoe (2), an upper shoe (4), a movable part (3) disposed between said lower and said upper shoe, a retaining member disposed between said lower and said upper shoe for preventing relative movement in the direction of a theoretical bridge axis which extends between said first bridge pier and a second bridge pier upon which said girder is intended to repose, said theoretical axis extending between said upper and lower shoe, a temporary support member (41) having a sliding member (44) temporarily fixed on said upper shoe, said temporary support member (41) having temporary fixing means, a movable member (8) disposed so as to move in the direction of said bridge axis on said sliding member (44);

(b) placing an elongated bridge girder with a sole plate (5) affixed thereto in a predetermined position on said movable member (8) pointing in the direction of said second pier;

(c) pushing out said bridge girder to a position near an installation position of said girder in the direction of said second pier along said theoretical bridge axis, together with said movable member (8) on said temporary support member (41);

(d) removing said temporary fixing means from said temporary support member (41) with said upper shoe to be able to move said temporary support member (41) in regard to said upper shoe in the direction of said second pier along said bridge axis, while attaching to said sole plate (5) a coupling member (6) which projects out from a lower surface of said girder in a position near an installation position of said bridge girder;

(e) thereafter again pushing out said girder and pushing out said temporary support member (41) on said upper shoe (4) by said coupling member (6) so as to displace said temporary support member (41) and said movable member (8) by said coupling member (6) on said upper shoe (4); and then, (f) in said position, fixing said upper shoe (4) and said sole plate (5) in engagement with each other through said coupling member (6).

2. The method as claimed in claim 1 including the steps of forming notches on said upper shoe, forming projections on said lower shoe and engaging said retaining member (40) between said notches and said projections.

3. The method as claimed in claim 2 including the steps of forming an inwardly concave surface (13) on said lower shoe (2), forming a convex curved surface (10) on said movable part (3) so that said concave and convex surfaces are in sliding contact.

4. The method as claimed in claim 3 including the steps of forming a slot on the upper surface of said upper shoe and a slot on the lower surface of said coupling member, and inserting a retaining member between said slots.

* * * * *